United States Patent [19]

Filippeschi

[11] 4,005,781

[45] Feb. 1, 1977

[54] DEVICE FOR ROTATING RAILS AND ROLLED SECTIONS ABOUT THEIR LONGITUDINAL AXES

[75] Inventor: Rolando Filippeschi, Piombino (Leghorn), Italy

[73] Assignee: Acciaierie Di Piombino S.p.A., Italy

[22] Filed: July 29, 1975

[21] Appl. No.: 600,182

[30] Foreign Application Priority Data

Aug. 1, 1974 Italy ..... 12914/74

[52] U.S. Cl. ..... 214/1 QG; 214/1 QA

[51] Int. Cl.[2] ..... B65G 47/14; B65G 47/82

[58] Field of Search ..... 214/1 Q, 1 QA, 1 QG; 198/283, 246

[56] References Cited

UNITED STATES PATENTS

| | | | |
|---|---|---|---|
| 3,308,969 | 3/1967 | Orms et al. | 214/1 QA |
| 3,499,548 | 3/1970 | Kruse | 214/1 Q |

FOREIGN PATENTS OR APPLICATIONS

| | | | |
|---|---|---|---|
| 1,366,403 | 6/1964 | France | 214/1 QG |
| 951,740 | 3/1964 | United Kingdom | 214/1 QG |

*Primary Examiner*—Robert S. Ward, Jr.
*Attorney, Agent, or Firm*—Robert E. Burns; Emmanuel J. Lobato; Bruce L. Adams

[57] ABSTRACT

The invention relates to a device for rotating rails and rolled sections in general about their longitudinal axis when they have to undergo very severe quality controls.

5 Claims, 4 Drawing Figures

DEVICE FOR ROTATING RAILS AND ROLLED SECTIONS ABOUT THEIR LONGITUDINAL AXES

BACKGROUND OF THE INVENTION

It is well known that the rolled sections in general and particularly the metal rails for railroads have to undergo very severe controls. Besides the normal destructive and not-destructive controls, particularly for the rails a careful visual control of all of the four faces of the rail is required. For said visual control it is necessary to turn over manually, through special handling keys, the rail about its longitudinal axis, so as to turn sequentially upwards the four faces thereof. It is to be noted that said rails have a length up to 36 meters and thus their weight is considerable. Notwithstanding said keys, the manual overturning of said rails is a very tiring work with many risks, as a matter of fact, the last part of the overturning step on each face takes place by gravity and in order to brake it, the operators have to reverse the direction of application of the force up to that moment exerted for performing the first part of the rail rotation.

OBJECT OF THE INVENTION

In view of the foregoing, the invention aims at overcoming said difficulties in a simple and sure way, by means of a device provided with power means and requiring only the control of a single operator.

SUMMARY OF THE INVENTION

The device for the rotation of rails and rolled sections in general about their longitudinal axis according to the present invention comprises a fork suitable to be disposed around the section core, said fork is mounted perpendicularly on a bar hinged, at its opposite end, to a vertically movable support; power means being provided for controlling the translation of said support along its substantially vertical path.

The above support has upper and lower connections to a handling rope extending between two return rollers, an upper and a lower one, said power means controlling the displacement of said rope in either direction.

Said upper return roller is connected to a second roller beyond which said rope is kept tightened by gravity through a suitable weight connected to the first end thereof, said power means being connected to the lower return roller preferably constituted by a winding drum for said rope. Said winding drum is associated to a driving means, controlled in either direction by an operator through pedals, said driving means being provided with a transmission, preferably worm wheel/endless screw type, for transmitting the motion to either direction to said winding drum for the rope. The above device is mounted on a movable carriage perpendicularly to the rail axis and in front of the ends thereof. Finally, according to the invention, said bar comprises at its inner end a cross bar perpendicular to the axis of said bar and hinged at its bottom to said support inside a through cavity provided in the support body.

BRIEF DESCRIPTION OF THE DRAWINGS

In order that the invention may be clearly understood, it will now be described, by way of example, with reference to the accompanying drawings, wherein.

DESCRIPTION OF THE PREFERRED EMBODIMENTS

Figure 1:
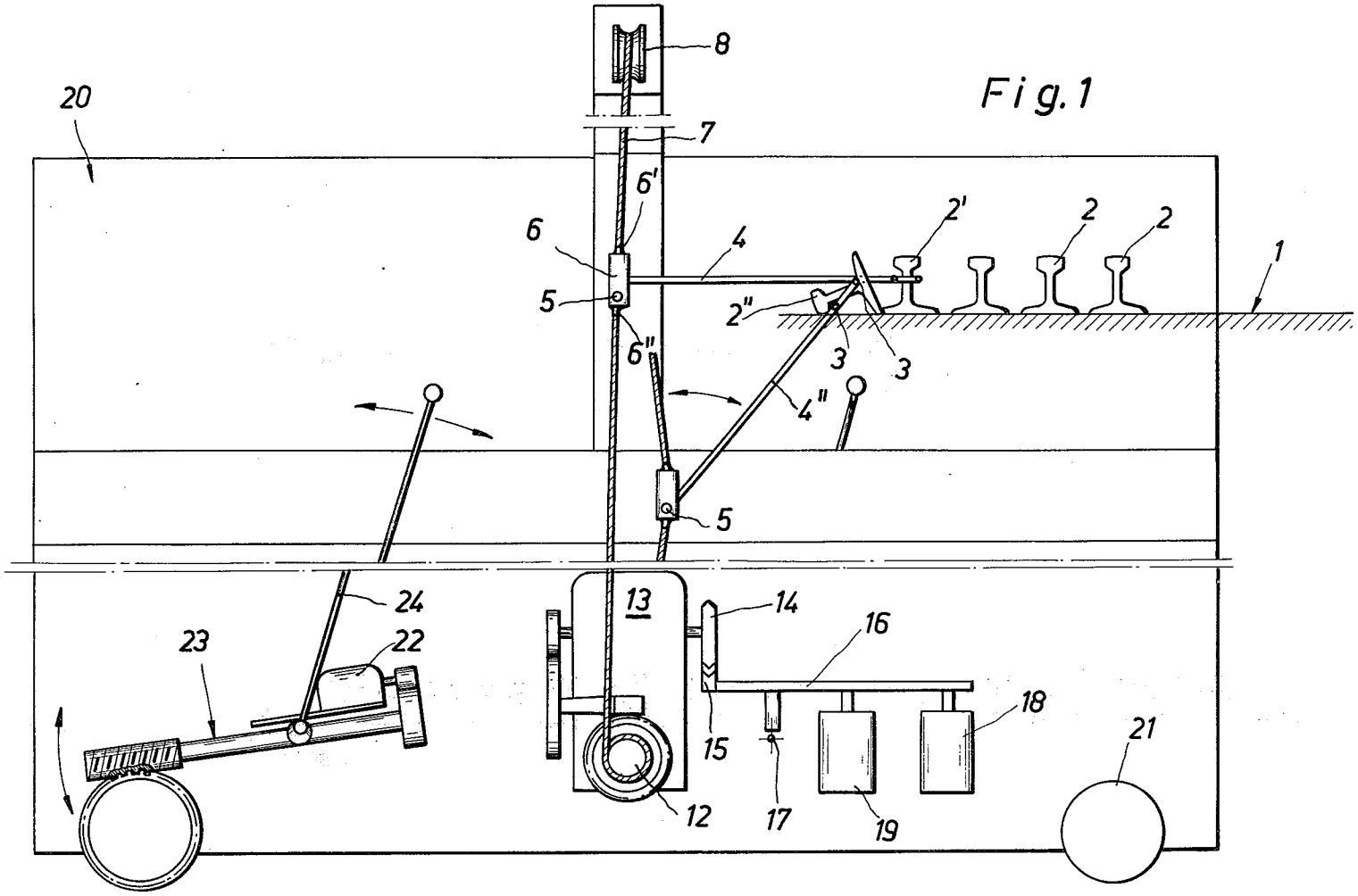
FIG. 1 is a front view of the device according to the invention.
Figure 2:
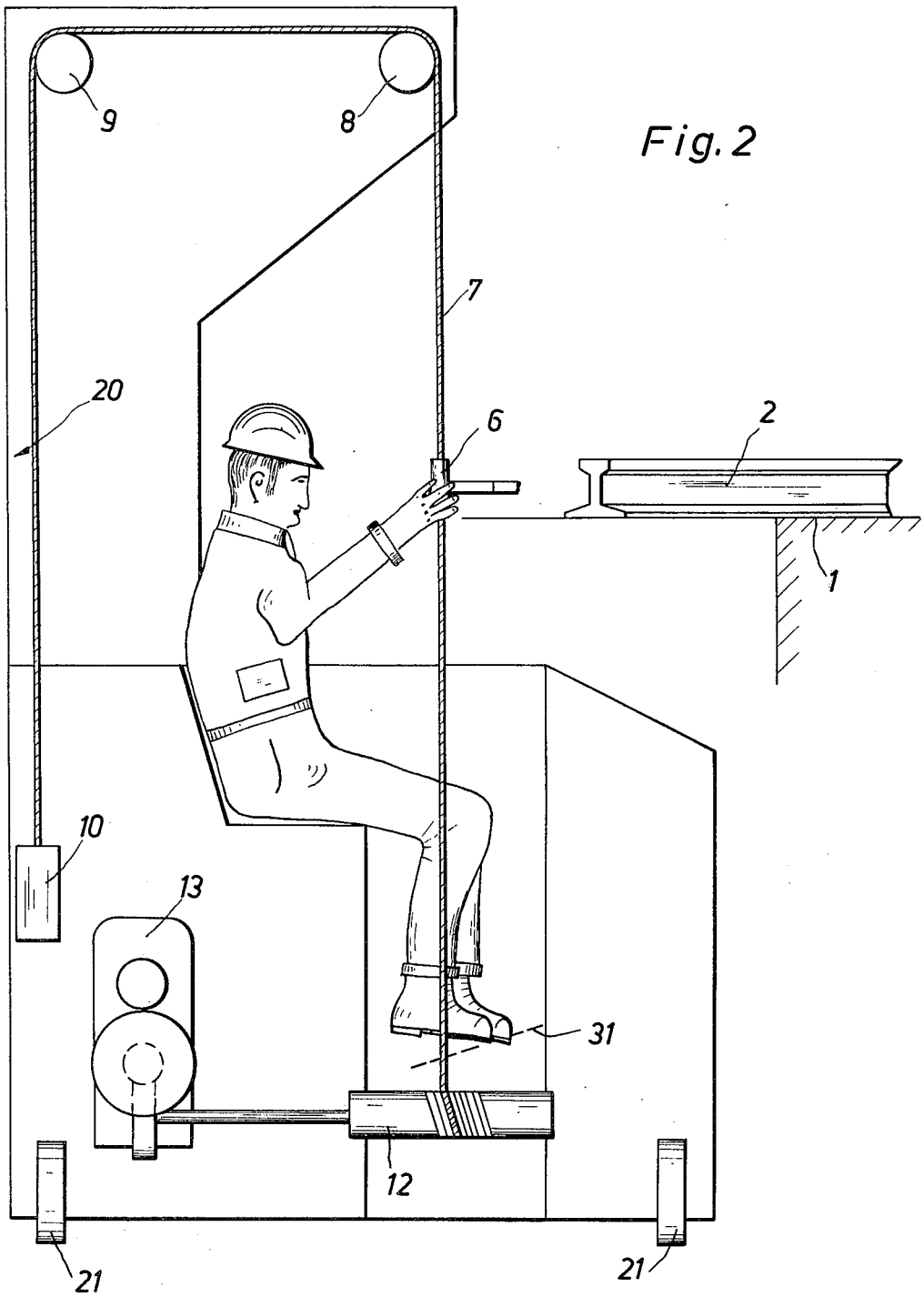
FIG. 2 is a side view of said device.

With particular reference to the above drawings, on a check surface are arranged butted a series of rails 2 which must undergo a visual check on all their four faces for checking the possible presence of surface defects; 2' denotes the last rail in the row and 2'' the same rail in a laterally overturned position.

According to the invention, said overturning is performed by means of a pair of parallel teeth 3 which project perpendicularly from the outer end of a rod 4 hinged in 5 to its inner end.

Both the rotation pivot 5 of said rod 4 and said teeth 3 are parallel to each other and to the axis of said rails 2. Said rod 4 is thus suitable to move about said pivot 5 in a plane substantially perpendicular to the rail axis. Further, said rod 4 is journalled in 5 on a support 6 provided with suitable connecting means 6' and 6'', by a rope 7 which on top is tightened by a weight 10 through return pulleys 8 and 9, while below said support 6 it is wound around a drum 12.

Therefore, said support 6 and thus the pivoting point 5 of said arm 4 will move upwards or downwards according to the possible rotation of said drum 12.

Said drum 12 is rotated by a suitably powered engine 13 through a reduction system comprising at least a worm wheel/endless screw means, in such a way with any force applied to said rope 7 with the engine 13 not operating, the rotation of said drum 12 will be prevented by the irreversibility of the motion of the worm wheel/endless screw means. Said reduction unit, or the engine 13, is provided with a braking pulley 14 associated to a braking pad 15 mounted on the end of a lever 16 pivoted in 17; a weight 18 causes said pad 15 to be blocked on said pulley 14 when, for instance for failure of electric current, said engine 13 stops and consequently stops the action of the piston 19 which, in its normal position, keeps said pad 15 and said pulley 14 apart from each other.

Obviously, for stopping said engine 13 in absence of power, any other known system may be used.

The whole above mentioned is housed within a carriage 20 movable on wheels 20 along rails not shown which extend parallel to the edge of the load plane 1 the rails 2 are arranged on.

Such a carriage comprises obviously an engine 22 which causes the movement thereof to both directions by means of a reduction gear 23 controlled by a lever 24.

Figure 3:
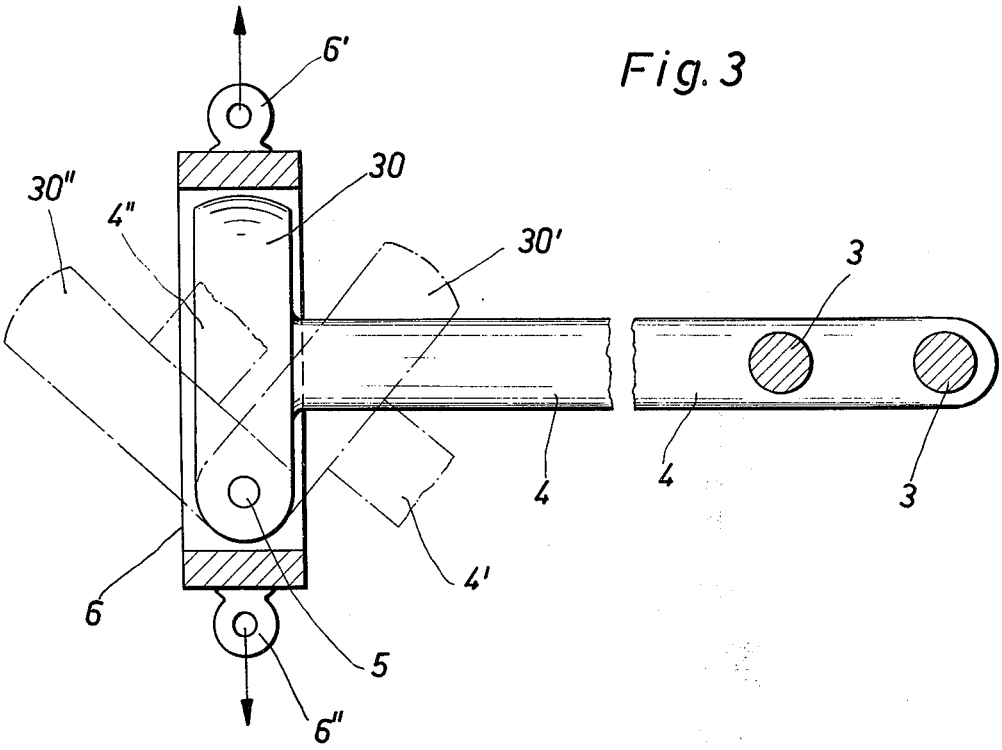
FIG. 3 is a view of an enlarged detail of FIG. 1.
Figure 4:
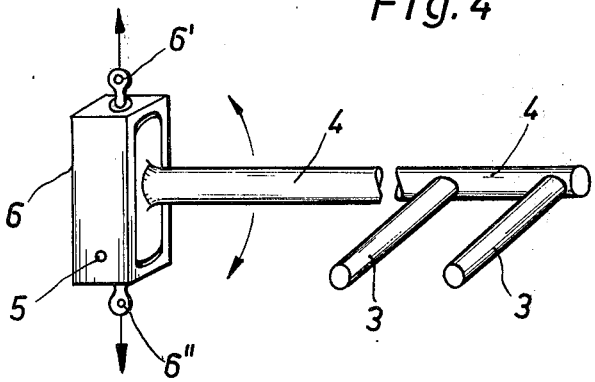
FIG. 4 is a perspective view of the detail shown in FIG. 3.

In the embodiment shown in detail in FIGS. 3 and 4, said rod 4 ends, at its inner end, with a cross bar 30 provided at its bottom with a bore for a pivot 5. Said cross bar 30 is housed within a through cavity arranged on said support 6, so that the whole formed by the cross bar 30 and bar 4 may rotate about said pivot 5 as shown in broken lines in 30'-4' and dotted lines in 30''-4''.

For the operation of the device, the operator seated on the suitable seat provided on said carriage 20, actuates to either direction the lever 24 so as to position the fork formed by the two teeth 3 in front of rail 2' to be turned over. At this point, the operator leaves said lever 24 and arranges said fork formed by the teeth 3 around the end of the stem of said rail 2'. In order to perform the last mentioned operation, the operator may move slightly said support 6 upwards or downwards as required, by actuating the engine 13, so as to cause the winding or unwinding of said rope 7 on said drum 12. The engine 13 is controlled through a pedal, shown only diagrammatically in the drawings, so that the operator may have both hands free.

When the fork formed by the teeth 3 is arranged around the stem of the rail 2', the winding of the rope 7 onto drum 12 causes said support 6 to lower to the position shown e.g. by a thin line in FIG. 1; said bar 4 rotates upwards about the pivot 5 and the rail is overturned leftwards as shown by 2'' in FIG. 1.

Said rail may be rotated in an opposite direction by causing said support 6 to rise, through a partial unwinding of said rope 7 from said pulley 12. By stopping said engine 13 when a rail is in an intermediate position between those denoted by 2' and 2'' in FIG. 1, the rail is kept stationary in said position.

It is important to note once more that the single operator needed performs control operations only and no hard manual work.

It is to be understood that the invention is not limited to what described. It is intended to cover all modifications and equivalents within the scope of the appended claims.

What we claim is:

1. A device for rotating rails and rolled sections in general about the longitudinal axis, comprising a fork suitable to be disposed around a section web, a substantially vertically disposed movable support, a bar hinged to said support, said fork being mounted perpendicularly on said bar hinged at its opposed end to the vertically movable support, power means for controlling the translation of said support along its substantially vertical path, a handling rope, two return rollers having their axes of rotation spaced, said support being connected on top and bottom to said handling rope tightened between said two return rollers, an upper and a lower one, and said power means controlling the motion of said rope in either of opposite directions.

2. A device according to claim 1, wherein said upper return roller is connected to a second roller beyond which said rope is kept tightened by gravity by means of a suitable weight applied to the first end thereof; said power means being connected to the lower return roller, and said power means consisting of a winding drum for said rope.

3. A device according to claim 2, including driving means connected to said winding drum, and controllable in both directions by an operator through pedal means for controlling of said driving means, said driving means having a transmission comprising a worm wheel of the endless screw type, for transmitting motion in opposite directions to said drum for winding said rope.

4. A device according to claim 3, a carriage movable perpendicular to the rail axis, and means mounting the device in front of the end thereof.

5. A device according to claim 3, wherein said bar comprises at its inner end a cross bar perpendicular to the axis of said bar, said cross bar being hinged below said support inside a through cavity provided within the support.

* * * * *